United States Patent [19]

Ramsey et al.

[11] Patent Number: 5,040,698

[45] Date of Patent: Aug. 20, 1991

[54] CONTAINERS

[75] Inventors: Christopher P. Ramsey, Uffington; Paul C. Claydon, Wantage, both of United Kingdom

[73] Assignee: CMB Foodcan plc, United Kingdom

[21] Appl. No.: 627,424

[22] Filed: Oct. 15, 1990

[30] Foreign Application Priority Data

Oct. 24, 1989 [GB] United Kingdom ..... 8923909.9

[51] Int. Cl.[5] ..... B65D 7/02

[52] U.S. Cl. ..... 220/671

[58] Field of Search ..... 220/671, 673, 672, 674, 220/669

[56] References Cited

U.S. PATENT DOCUMENTS

| | | | |
|---|---|---|---|
| 6,391 | 4/1875 | Scaite | 220/671 |
| 28,014 | 4/1860 | Scaite | 220/671 |
| 679,658 | 7/1901 | Witt | 220/671 |
| 1,014,491 | 1/1912 | Lamming | 220/671 |
| 2,005,641 | 6/1935 | Stanitz et al. | 220/671 |
| 3,317,110 | 5/1987 | Palmer | 220/671 |
| 3,402,871 | 9/1968 | Palmer | 220/671 |
| 3,563,408 | 2/1971 | Leonandus | 220/671 |

*Primary Examiner*—Joseph Man-Fu Moy

*Attorney, Agent, or Firm*—Diller, Ramik & Wight

[57] ABSTRACT

A metal can body comprises an end wall and a tubular side wall. The side wall has upper and lower cylindrical portions joined by a plurality of concave flexible panel portions and ribs. The benefit arising from the flexible panels in the side wall is the ability to attenuate the internal pressure changes arising during thermal processing of lidded cans by providing a elastic mechanism which enhances the change in internal can volume.

12 Claims, 4 Drawing Sheets

CONTAINERS

FIELD OF THE INVENTION

This invention relates to containers and in particular to metal can bodies having an end wall and, upstanding from the periphery of the end wall, a side wall which includes a plurality of longitudinal flexible panels; and more particularly but not exclusively, to metal cans intended to be closed by a lid such as are used to contain processed foods or beverages.

During the manufacture and use of cans each can body is subjected to a variety of stress loadings. For example, during formation of a flange on the body, or double seaming of a lid onto the flange, the side wall is subjected to axial compression.

During processing of a filled and lidded can for a processed food, the can may initially be subjected to an exterior overpressure as steam is forced into the retort vessel. Hitherto it has been customary to provide circumferential beads around the can side wall which withstand most of this overpressure by reaction of the hoop stress within the can side wall. Some flexing of the end and lid of the can will also occur. Since maximum allowable hoop stress is equal to a function of the material thickness, reduction in side wall thickness is at present limited by the overpressure requirement.

Therefore, one objective of this invention is to provide a metal can which attenuates the pressure differential by allowing the side walls to flex inwards, thus reducing the can volume, and increasing the can internal pressure. The benefit over end and lid flexing is that the body wall has a larger flexible area than that of the ends so that greater volumetric changes can be accommodated.

As the cans rise in temperature within the retort a differential expansion rate of typically 700% is seen between the product and metal can. Hitherto it has been customary to fill the can with a quantity of product less than the volume of the can in order to leave a headspace. The headspace protects the can from the hydrostatic pressure generated during the volumetric expansion of the product by allowing the headspace to be compressed. However, the use of a headspace has the disadvantages that the can fill volume is reduced, and if oxygen is included in the headspace, this may result in degradation of product and/or lacquer system. Conventional can ends and lids for foods are commonly formed with concentric corrugations which allow for volumetric expansion of the can through doming of the ends. Such can lids relax back only partially on cooling and thus a partial vacuum is retained in the can after processing. Therefore, a further objective of this invention is to allow filling with a minimal headspace and to absorb the volumetric expansion of the product by outwards flexing of the side walls. The benefit over end and lid flexing being that greater volumetric changes can be accommodated.

When cans reach the desired lethal thermal treatment temperature an absolute pressure of around 4½ atmospheres is generated within the can. Cans remain at elevated temperature until the heat is fully transmitted through the product. At this stage the retort is cooled whilst maintaining a differential pressure of typically 2 atmospheres until the can is sufficiently cooled to allow removal from the retort to atmospheric conditions. During this stage internal pressure may considerably exceed the external pressure. Conventional cans overcome this pressure by producing an unrelieved hoop stress within the side wall and flexing of the end and lid.

Therefore, a further objective of this invention is to allow outwards flexing of the side wall to a point where the sum of the localised hoop forces within the panels is sufficient to withstand this pressure without permanent deformation. This outward flexing gives a significant increase in volume.

After the cans have been processed, the product gradually cools to ambient temperature. This causes a differential volumetric contraction between product and can, which is particularly acute if the can was hot filled. In conventional cans this causes a partial vacuum within the can, because the lid has expanded and only partially contracted back, which is counteracted by the hoop stress generated within the circumferential beads.

Cans are generally transported on pallets which have a number of layers of cans stacked vertically. Typically a can on the bottom layer may experience an axial load of up to 400 lbf. Hitherto, the axial performance of food cans has been reduced by around 50% as compared to a plain wall can by inclusion of circumferential beads around the side wall.

A further preferred feature of the invention is to achieve the performance of a plain wall can under axial loading by limiting the rate of change of can cross sectional shape along the side wall, which we achieve by controlled setting of the maximum blend angle from panel to cylinder.

Cans with thin flexible side walls are vulnerable to abuse in transit and at risk of denting in display bins at the point of sale so it is necessary for the side wall to include localised strengthening features.

BACKGROUND ART

Expansion panels are provided in known bottles blow moulded in polymeric material because the bottle neck and cap do not permit flexure to accommodate pressure changes in a bottle. Examples of plastics bottles having expansion panels in their side wall are described and shown in European patent application Published No. 0279628 (YOSHINO KOGYOSHO) and British patent application Published No. 2188272. In both these publications the bottle has a neck supported on a shoulder which connects to a substantially cylindrical body portion that is provided with a plurality of flexible panels each joined to the next by a column shaped rib extending approximately half the height of the bottle. These complicated shapes are easily achieved by blow moulding of thermoplastic material but difficult to achieve on a metal can body because the metal has limited ductility and stiffer nature. Both these prior art bottles have an array of annular beads in the shoulder or upper part of the body and this "hooped" zone cannot contribute to the desired expansion of container volume and detracts from columnar strength required to support axial loading that arises when bottles are stacked on pallets.

In European patent application, Published No. 0246156 (The Fresh Juice Company) a bottle of square cross section is blow moulded from high density polyethylene to comprise a neck supported by a shoulder which connects with an upper annulus of square section having smooth surfaces, and a lower annulus connected to the top annulus by a recessed body portion which includes an elliptical flexible panel in each rectilinear face. Mass produced cans for processed foods and beverages are usually made cylindrical because round can ends are easier to attach to the sidewall by means of a double seam than are rectangular cans such as are used for corned beef tins. The expansion panels in this publication are not such as would permit substantial inward flexing of a metal can during processing of a food product.

EP 0068334 (TOPPAN PRINTING CO) describes a cylindrical paper container body that may include a metal foil layer. The cylindrical side wall has cylindrical portions, at each end, which are joined by a plurality of longitudinal panels each joined to the next by a linear crease line. Each panel is convex initially and pressed to a flat configuration after filling of the container while the contents cool. Whilst the paper materials described are able to tolerate creasing, metallic side wall materials of stiff temper, such as temper 4 steel or wall ironed side walls may be cracked by sharp crease lines. Furthermore, the rolling operation after filling is not desirable.

British Pat. No. 703836 (FRANGIA) describes metal containers having a side wall integral with an end wall. The side walls described include tapered side walls and substantially cylindrical side walls but other shapes, such as rectangular or oval, are also shown. In each example the side wall comprises a peripheral flange; a cylindrical portion dependent from the interior of the flange; a body portion dependent from the cylindrical portion and comprising a great number of convex ribs and concave grooves forming a sinusoidal profile; and a second cylindrical portion connected to the end wall.

Although the purpose of the ribbed body portion is not explained it is believed that these ribs and grooves are to provide strength against a load applied axially to the containers, as would arise when filled containers are stacked. The ribs and grooves provide strengthening of the container and have too small a circumferential extent in relation to the thickness of the container wall to permit substantial flexing during processing a food product.

SUMMARY

We have discovered that metallic can bodies can achieve these objectives if the side wall is provided with a plurality of longitudinal flexible concave panels of controlled width, each panel being joined to the next at a convex rib such that a fluted profile is formed.

It has been found that the number of panels should preferably be a multiple of 3 such that contraction of the can to a nearly polygonal shape—as shown in FIG. 2*b*—can occur. It has been found that between 12 and 24 panels is useful in a food can and that 15 panels is particularly useful.

It has also been found that a can having a plurality of flexible panels is useful for carbonated beverages. Such cans do not suffer overpressure and thus only need to provide some volumetric expansion. During handling of can bodies small dents may be made in the cylindrical wall and these dents provide localised points of weakness which can lead to creasing during flanging of the neck and fitting of the lid when the body is subjected to an axial load. It has been found that the operation of panelling removes a number of such dents and gives added axial strength to the can. For such cans up to 45 panels has been found to be useful. In a filled can the panels flex outwardly between the ribs and become barely visible.

Accordingly this invention provides a metal can body comprising an end wall and a tubular side wall upstanding from the periphery of the end wall wherein the tubular side wall includes a plurality of adjacent concave longitudinal panels each of which extends parallel to the central axis of the side wall to connect with a cylindrical portion of axial length less than 25% of the height of the side wall, at both ends of the panels, characterised in that, the can body is made from sheet metal; each panel is flexible and subtends at the central axis an angle between 8° and 30° and is joined to the adjacent panels at a convex rib; wherein the perimeter length in the region of the can which contains the ribs and recessed panels is equal to the circumference of an imaginary circle with centre point on the central axis of the can, and radius substantially equal to the distance from the central axis of the can to the apex of the externally convex ribs.

In one embodiment the distance from the central axis of the can to the apex of the externally convex ribs is equal to the radius of the upper and lower cylindrical portions of the can. In this case it will be understood that the can has been made from a plain cylindrical can body and that the panelling has been formed without stretching of the material of the body.

Each recessed panel preferably terminates in a panel portion inclined to the cylindrical portions of the side wall at an angle K° between 150° and 177°. Each recessed panel may be arcuate or prism atic in cross section and an externally convex rib joins each recessed panel to the next panel around the can body.

It is desirable that the internal radius of the convex ribs is less than 5% of the radius of the cylindrical portions. The small angle allows for a relatively great depth to the panels. If the angle is too small however it will lead to failure of the can through cracking.

The metal can may be provided with a convex annular bead which joins the side wall to the end wall: this annular bead can be used to improve abuse resistance and facilitate labelling, transport by rolling and stacking of the cans.

An annular neck portion of reducing diameter may connect the upper cylindrical portion to an outwardly directed flange of external diameter smaller than that of the rest of the side wall.

Metal cans according to this invention may be deep drawn to have the end wall and side wall drawn to shape from a single piece of sheet metal. The side wall may be made thinner than the end wall by a wall ironing process. Alternatively the side wall may be formed from a rectangular blank which is formed to a cylinder having a side seam which is preferably welded. Panels and ribs may then be formed in the welded cylinder.

This invention permits manufacture of the can bodies from a preliminary cylindrical shape with minimal material stress during forming.

Commonly, food cans are filled with a product which becomes solid after processing and cooling to ambient temperature. Hitherto, when the lid is removed by the consumer, it has been difficult to remove the total product volume from the can because the product adheres to, and is wedged in by, the side wall tapers which are an intrinsic part of circumferential beading.

Therefore, a further benefit provided by this invention is a metal can which allows product release with minimal residual product remaining within the can. This is achieved by two mechanisms; firstly by limiting the rate of change of can cross section along the side wall, and secondly by allowing the side walls to flex outwards to their original shape when the lid is opened and the partial vacuum within the can is released.

Cans are known that have large flat panels in the side wall but experience has shown them to be prone to jamming in conveyor systems because typically the can width varies with orientation of the can body. A further objective of this invention is to minimise the risk of this jamming. This is achieved by three mechanisms; firstly the top and bottom of the side wall is cylindrical which allows accurate can location in subsequent processing machines; secondly, the portion of the side wall that contains the panels has a maximum radius which is equal to the radius of the cylindrical side wall portions; and thirdly, preferably the can has an uneven number of panels so that the variation in can width is minimised.

A further advantage is that the ribbed side walls provide resistance to abuse whilst still permitting application of paper labels or shrink wrap labels to identify the products therein. Ink decoration is also possible.

DESCRIPTION OF THE PREFERRED EMBODIMENTS

Figure 1:
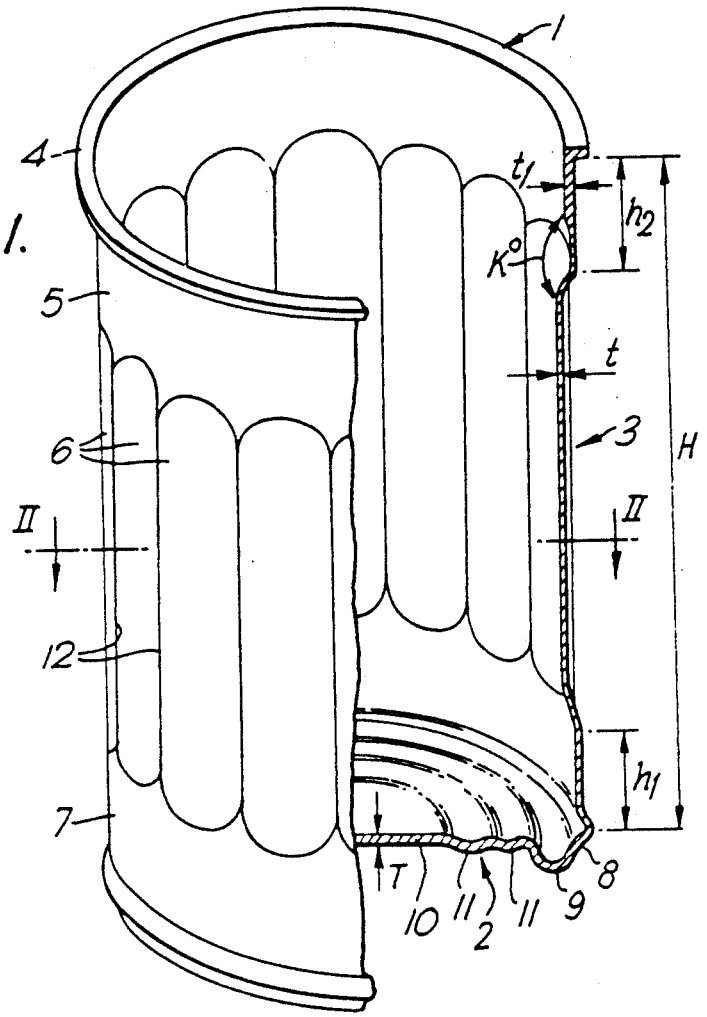
FIG. 1 is a part-sectioned perspective sketch of a first embodiment of a can body.

In FIGS. 1 and 2, a first embodiment of the can body 1 for use as a container for processed foods, comprises a circular end wall 2 and a tubular side wall 3 upstanding from the periphery of the end wall 2. Typically a cup is drawn from a blank of sheet metal, such as tinplate, electro-chromecoated steel or an aluminum alloy of the order of 0.0118" (0.3 mm) thick. The cup is then wall ironed to a final overall shape 73 mm diameter by 113 mm tall having a side wall thickness "t" 0.0036" (0.093 mm) and a bottom wall thickness "T" unchanged from 0.0118" (0.3 mm). Preferably, the flange 4 and an adjacent margin "m" of the side wall, have a greater thickness $t_1$ than the side wall, typically 0.006" (0.155 mm).

In FIGS. 1 and 2 the side wall 2 of the can body can be seen to comprise a peripheral flange 4 defining the mouth of the can body, a first cylindrical portion 5 depending from the interior of the flange, a plurality of externally concave recessed panels 6 extending downwards from the first cylindrical portion, a second cylindrical portion 7 beneath the concave panels and an optional annular bead 8 which connects with the periphery of the end wall. The end wall 2 comprises an annular stand bead 9 surrounding a central panel having shallow annular corrugations 11 which permit the end wall to distend under the influence of internal pressure in the can body.

FIG. 2 shows that each concave recess panel 6 is connected to the next by an elongate rib 12 formed by a fold of internal radius "r" less than 5% of the radius "P" of the cylindrical portion. By way of example, if P is approximately 36.5 mm, r will be less than 1.83 mm, but not so small as to put the metal side wall in danger of cracking. This arrangement of panels and ribs creates a fluted profile in the median portion of the can.

Each concave panel 6 (measured from rib to rib on either side) subtends an angle A° of 24° at the central axis of the side wall 3. Thus, this embodiment has 15 panels. However, other values of A° are useful if subtending an angle at the central axis in the range of 15° to 30°. That is to say there may be 12 to 24 panels. Preferably, each panel 6 flares into the cylindrical portion at each end as a gently curving profile with maximum slope at an angle K of 150° but approach angles in a range of 150° to 177° are useful. The circumferential perimeter length is constant during this transition, from which it follows that the radius of curvature (perpendicular to the can axis) is substantially constant at all levels over the whole height of the panels and is equal to the radius of the cylindrical portions 5,7 of the can less twice the rib radius, i.e. $R=P-2r$. The cylindrical height h1,h2 of each cylindrical portion 5,7, is less than 25% of the height H of the side wall 3 and preferably less than 10%. As an example $h_1=5$ mm and $h_2=5$ mm on a 113 mm high can with 73 mm diameter.

Figure 2A:
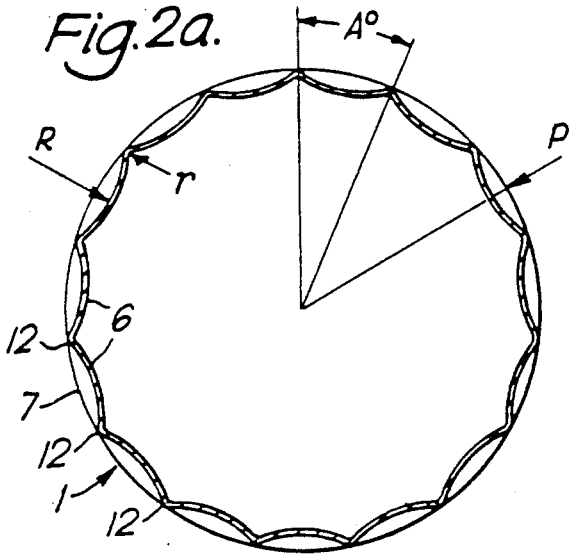
FIG. 2*a* is a view of the can body of FIG. 1 sectioned on line II—II.

The radius of curvature of a concave panel 6 is denoted R and is typically within a range of 20 mm to 100 mm so that the panel is shallow enough to be flexible. In FIG. 2*a* the radius of curvature R is approximately equal to P, the radius of the cylindrical portions, namely 36 mm.

The ribs 12 and cylindrical portions 5, 7 define side wall portions that support compressive loads in the axial direction, such as arise during flanging of the body and double seaming of a lid onto the can body such that the can in FIG. 2*a* has an axial load capacity of approximately twice that of a conventional can, subject to any loss of strength at the rolling bead 8. The concave recessed panels 6 define flexible surfaces which are able to distend when subjected to pressure inside the body 1 as arises during thermal processing of a product therein. The configuration of fifteen ribs 12 and and fifteen concave recesses 6 is able to survive transit abuse and normal display at point of sale.

Figure 2B:
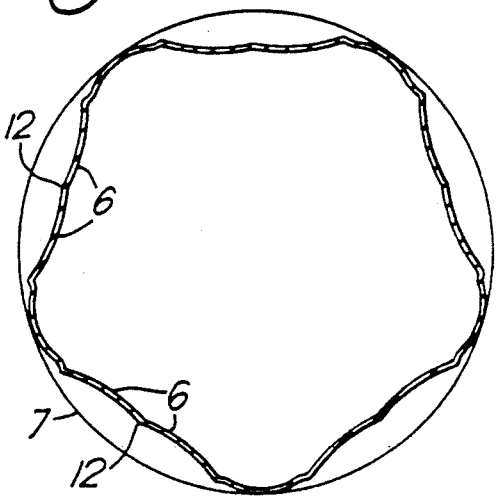
FIG. 2*b* is like view to FIG. 2*a* showing the side wall shape under an external overpressure.

FIG. 2*b* shows a five sided shaped to which the side wall elastically deforms during subjection to an external pressure of 2.5 atoms. absolute pressure as arises in hydrostatic cookers. As can be seen in FIG. 2*b* every third panel has flipped outwards enabling the panels therebetween to move radially inwardly in pairs. On abatement of the overpressure the can reverts to the shape shown in FIG. 2*a*. FIG. 2*b* clearly shows that substantial volume changes in product in the can may be accommodated. It will be understood that maximum deformation occurs at the axial mid-point of the panels.

The can of FIGS. 1 and 2 is made by deep drawing of a plain cylindrical body from a metal blank. The body is then formed with panels 6 and ribs 12 with minimal stretching of the material.

Figure 3:
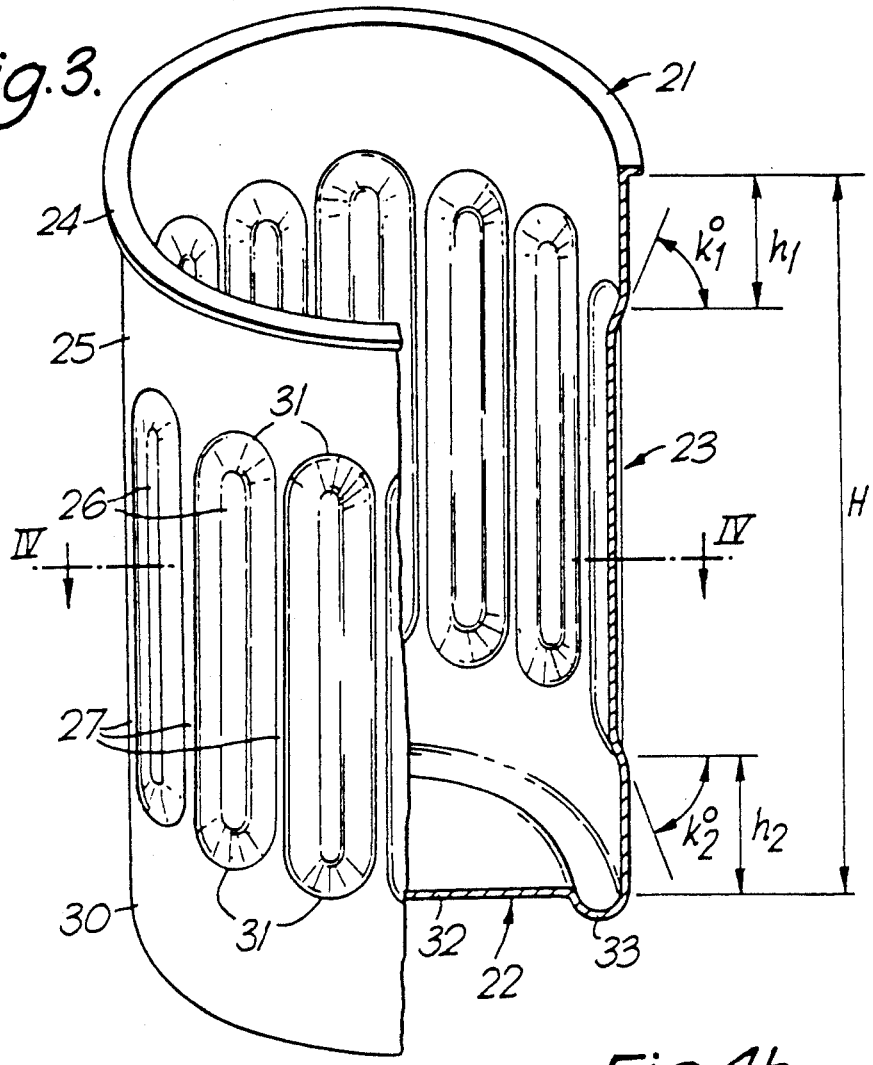
FIG. 3 is a part-sectioned perspective sketch of a second embodiment of the can body.
Figure 4A:
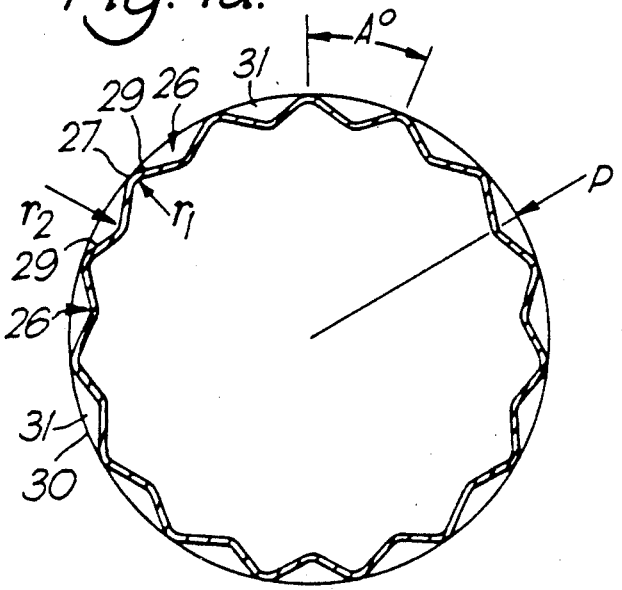
FIG. 4*a* is a view of the can body of FIG. 3, sectioned on line IV—IV.

FIGS. 3 and 4 show a second embodiment of the can body in which the concave recessed panels have been modified to a prismatic shape and an alternative end wall 22 provided.

In FIGS. 3 and 4 a can body 21 has a circular end wall 22 and a tubular side wall 23 upstanding from the periphery of the end wall.

The side wall 23 has an outwardly directed flange 24, a first cylindrical portion 25 depending from the interior of the flange, a plurality of round bottomed "prismatic" panels 26 arranged around the body, each panel being joined to the next adjacent by an elongate rib 27. Each rib 27 is externally convex and comprises an arcuate convex surface flanked by inclined panel surfaces 29 that connect with a central arcuate spine of the "prismatic" panels 26 best seen in FIGS. 4*a* and 4*b*.

Figure 4B:
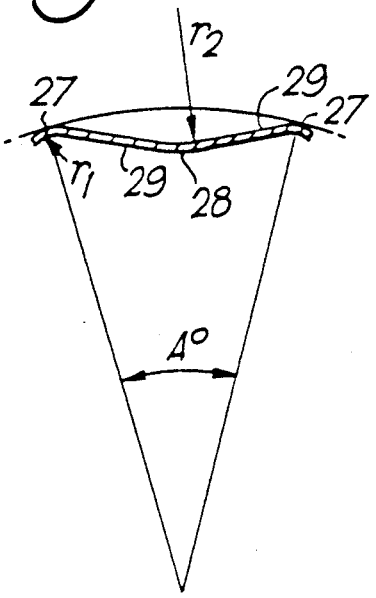
FIG. 4*b* is an enlarged fragmentary section of a panel and two ribs.

In FIG. 4*b* it will be seen that the prismatic panels 26 comprise in cross section, a pair of inclined flat surfaces 29 joined by an arcuate spine 28. The panels 26 join a rib 27 to each side. The ribs have an internal radius $r_1$ which in this example is approximately equal to the radius $r_2$ of the arcuate spine 28 at the centre of each panel 26. Each panel joins the lower cylindrical portion 30 at a sloping surface portions 31 which approach the adjacent cylindrical portions 25, 30 at a shallow angle. As in the embodiment described with reference to FIG. 1, this included angle between these sloping surface portions 31 and cylindrical portions 25, 30 is preferably within the range of 150° to 177°. (As shown in FIG. 3, these angles can be expressed as angles k1, k2 between a projected sloping surface and the horizontal, in the range of 60° to 87°). As already mentioned, the height of the cylindrical portions 25, 30 denoted h1 and h2 respectively, do not exceed 25% of the total can height H.

The end wall 22 comprises a flat central panel 32 surrounded by standbead 33 of convex arcuate cross section. If desired, the can body may be made by drawing a cup from sheet metal followed by ironing of the side wall of the cup to make a taller can. However the shaped can shown in FIG. 3 may be made by deep drawing so that side wall and bottom are of substantially equal thickness. The ribs 27 and panels 26 are subsequently formed in an operation which causes no further stretching of the material of the can.

If the can is wall ironed the flat central panel 32 and standbead 33 will be thicker than the side wall and relatively stiff, so that the can relies on flexibility of the panels 26 to accommodate change in volume of a product during thermal processing such as is applied to food products or pasteurising treatments applied to liquids.

Figure 5:
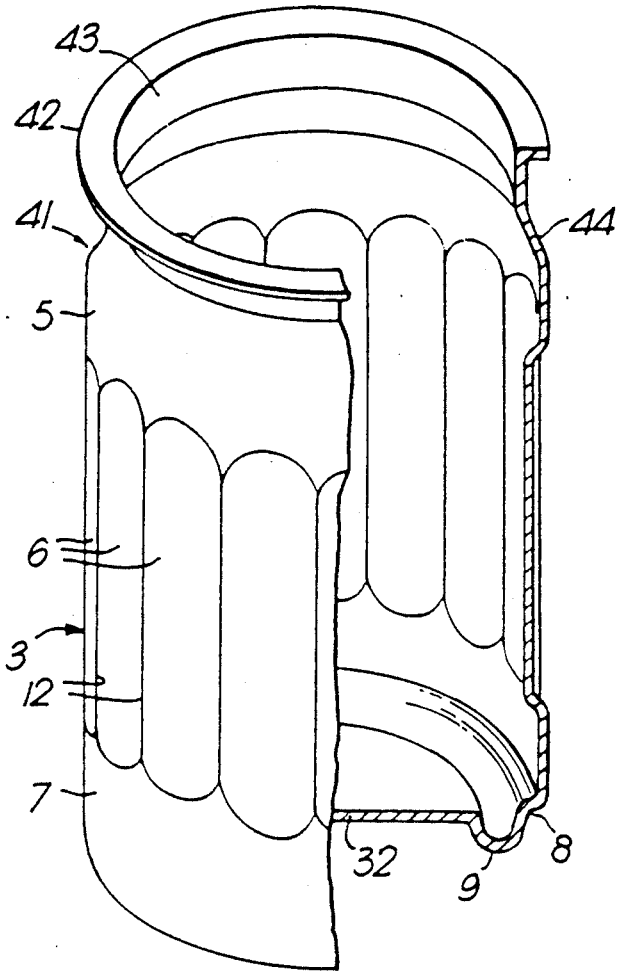
FIG. 5 is a part-sectioned perspective sketch of a third embodiment.

FIG. 5 shows a third embodiment of a food can body 41 which incorporates side wall features of the embodiment shown in FIG. 1 and end wall features of FIG. 3, so that the like parts are denoted with the integer numbers already used and require no further description.

Figure 6:
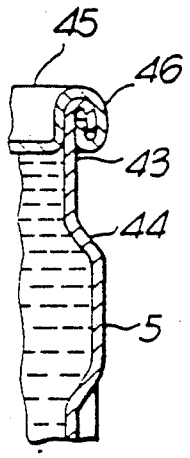
FIG. 6 is a fragmentary sectioned side view of the can body of FIG. 5, with a lid thereon.

However, the can body 41 shown in FIG. 5 has an outwardly directed flange 42 supported on a cylindrical neck 43 in turn supported on a shoulder 44 which flares inwardly from the upper cylindrical portion 5. FIG. 6 shows the shoulder neck and flange of FIG. 5 after attachment to a can end 45 by means of a double seam 46. The benefits of this arrangement of shoulder neck and flange are that:

(a) a smaller can end is required;

(b) the periphery of the double seam does not protrude beyond the side wall to give risk of cans overriding on conveyors or "BUSSE" packs;

(c) the periphery of the double seam does not protrude beyond the side wall allowing the can to be rolled in a straight line.

Figure 7:
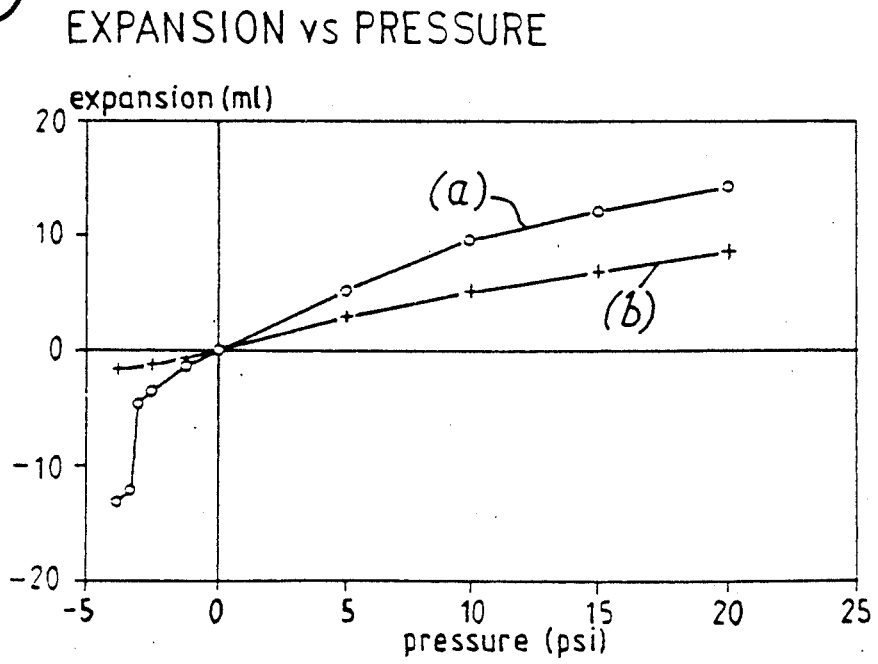
FIG. 7 is a graph of pressure inside a lidded can, as shown in FIG. 1, plotted against the change in volume, as compared to a circumferentially beaded can.

FIG. 7 is a graph obtained by applying internal pressure change to a can as described and shown in FIG. 1. In FIG. 7 the difference between internal pressure and external pressure is plotted against can volume. Comparing graph (a) arising from the cans described, with graph (b), a can relying solely on conventional expansion panels in the can bottom and/or can lid, it is apparent that the side wall panelling taught by this invention gives a much enhanced accommodation of volume changes in a product. In conventional cans the volumetric expansion is provided by doming of the can bottom and can lid. Conventional cans provide very little contraction whereas cans of the present invention are seen to contract in volume very substantially when subjected to an exterior overpressure.

When applied to cans for processed foods the invention permits reduction of the headspace (ullage) so that oxidative spoilage arising from entrapped oxygen is avoided.

Whilst the invention has been described in terms of side wall panels which are in cross section arcuate (FIG. 2) or prismatic (FIG. 4) it will be understood that other flexible panel surface will suffice such as for example semi-elliptical. Whilst the flared surfaces connecting the extremities of each panel to the adjacent cylindrical portion have been described as arcuate (FIG. 2) or sloping (FIG. 4) shallow composite curves may suffice.

The configuration of ribs and flexible panels is created by fold forming, care being taken to minimise any localised stretching. This has the benefits of reducing the risk of splitting, plus allowing the can to be lacquered whilst round and then formed—leading to a more even film weight distribution.

Figure 8:
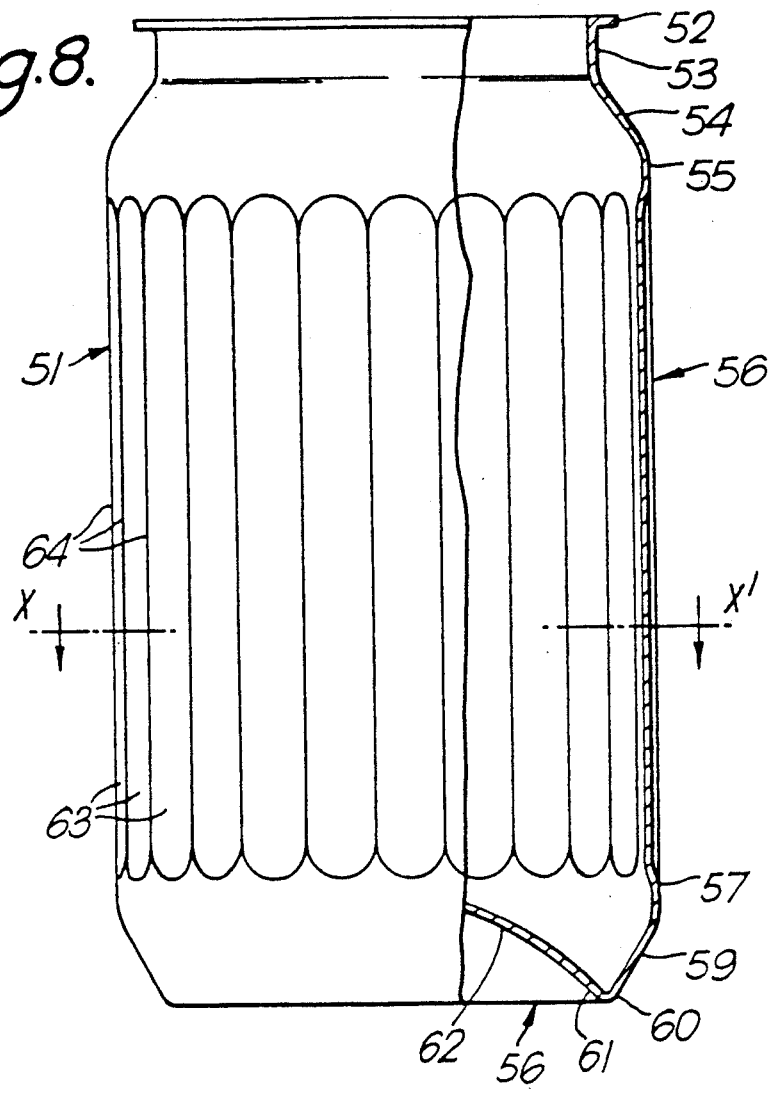
FIG. 8 is a part sectioned side view of a fourth embodiment.

FIG. 8 shows a fourth embodiment of the can 5 which comprises a flange 52, a neck portion 53 depending from the interior of the flange, a shoulder 54 flaring outwardly from the neck portion, a short cylindrical portion 55 which connects the shoulder to a panelled portion 56 which extends to a lower cylindrical portion 57, and a bottom wall 58 spanning the lower cylindrical portion. The shaped bottom wall is typical of beer or beverage can bottoms in having an outer frusto conical annulus 59, a stand bead 60, and inner frusto conical wall 61, and a central domed panel 62 supported by the inner frusto conical wall. The can of this embodiment is sutiable for carbonated beverages. Such cans are not subjected to exterior overpressures and thus do not need to be able to contract inwardly as in the case of food cans. As shown in FIG. 8 the panelled portion 56 of the sidewall has 30 panels 63, each joined to the next at a rib 64. Each panel 63 subtends at the central axis of the can an angle of 12°. Thus there are 30 panels. The concave radius of curvature of each panel is about 31 mm and substantially equal to the 32 mm radius of the upper and lower cylindrical portions 55, 57.

Whilst 30 panels are depicted in FIG. 8, a range of 24 to 45 panels is particularly useful for beer or carbonated beverage cans to permit stacking and cope with abuse in transit.

Figure 9:
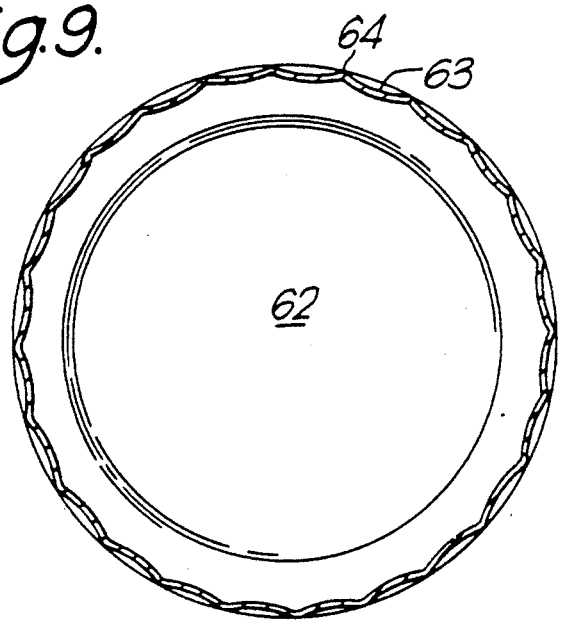
FIG. 9 is a view of the can body of FIG. 8 sectioned on line X—X[1] in FIG. 8.

The benefits arising from the can shown in FIGS. 8 and 9 are as follows:

Division of the thin walled portion of the can body wall into small panels by the introduction of typically 24–45 vertical ribs renders the can less sensitive to minor damage to the body walls such as may be introduced during manufacture, and subsequent handling either prior to, or subsequent to the panel and rib forming operation. Even if as many as 45 panels are provided this can still be achieved without stretching the body wall. Such panels are also still sufficiently deep to provide a useful expansion capability.

By this means, the axial load strength of the can may be increased, or alternatively, lightweighting of the body wall may be achieved without loss of strength.

Beverage cans of the type shown in FIGS. 8 and 9, having 30 vertical ribs, and an aluminium wall thickness of 0.004" (0.1 mm) have been made. In these cans, the neck 53 and shoulder 55 have a thickness of about 0.006" (0.15 mm) and the bottom 59 has a thickness of about 0.012" (0.3 mm). The average axial collapse failure strength of 50 cans was 317 lb.f, compared to that of 50 plain bodied cans at the same thickness of 273 lb.f, and at 0.0043" thickness of 325 lb.f.

Whilst the invention has been described in terms of small cans for food or beverages it is also applicable to larger cans such as A10 size (150 mm diameter by 180 mm height) and drum-like containers.

It will be understood that the cans may be made from various sheet metals such as tinplate, electrochromecoated steels of various chrome/chrome oxide forms. The sheet metal may be pre-lacquered or alternatively a laminate of sheet metal and a polymeric film may be used. Suitable films include polyethylene terephthalate, polypropylene or nylon.

We claim:

1. A can body comprising an end wall and a tubular side wall upstanding from the periphery of the end wall wherein the tubular side wall includes a plurality of adjacent concave longitudinal panels each of which extends parallel to the central axis of the side wall to connect with a cylindrical portion of axial length less than 25% of the height of the side wall, at both ends of the panels, characterised in that, the can body is made from sheet metal; each panel is flexible and subtends at the central axis an angle between 8° and 30° and is joined to the adjacent panels at a convex rib; wherein the perimeter length in the region of the can which contains the ribs and recessed panels is equal to the circumference of an imaginary circle with centre point on the central axis of the can, and radius substantially equal to the distance from the central axis of the can to the apex of the externally convex ribs.

2. A metal can according to claim 1, wherein the distance from the central axis of the can to the apex of the externally convex ribs is equal to the radius of the upper and lower cylindrical portions of the can.

3. A can body according to claim 1, wherein each recessed panel terminates in a panel portion inclined to the cylindrical portions of the side wall at an angle K° between 150° and 177°.

4. A can body according to claim 1, wherein each recessed panel is arcuate or prismatic in cross section in the plane perpendicular to the axis of the can.

5. A can body according to claim 1, wherein the internal radius of curvature of the convex ribs is less than 5% of the radius of curvature of the cylindrical portions.

6. A can according to claim 1, wherein a convex annular bead joins the side wall to the end wall.

7. A can according to claim 1, wherein an annular portion of reducing diameter connects the upper cylindrical portion to an outwardly directed flange.

8. A can according to claim 1, wherein the end wall and side wall have been drawn to shape from a single piece of sheet metal.

9. A can according to claim 8, wherein the side wall is thinner than the end wall.

10. A can according to claim 1 intended for use as a container for a processed food wherein the number of panels is from 12 to 24.

11. A can according to claim 10, wherein the number of panels is 15.

12. A can according to claim 1 intended for use as a container for a carbonated beverage, wherein the number of panels is from 24 to 45.

* * * * *